US010578294B2

(12) United States Patent
Beregszaszi et al.

(10) Patent No.: US 10,578,294 B2
(45) Date of Patent: Mar. 3, 2020

(54) REFLECTOR LAMP WITH IMPROVED HEAT DISSIPATION AND REDUCED WEIGHT

(75) Inventors: Andrew Howard Beregszaszi, Philadelphia, PA (US); Edward E. Bailey, Westampton, NJ (US)

(73) Assignee: ILLUMINATION MACHINES LLC

( * ) Notice: Subject to any disclaimer, the term of this patent is extended or adjusted under 35 U.S.C. 154(b) by 0 days.

(21) Appl. No.: 13/450,983

(22) Filed: Apr. 19, 2012

(65) Prior Publication Data

US 2012/0268942 A1 Oct. 25, 2012

Related U.S. Application Data

(60) Provisional application No. 61/476,778, filed on Apr. 19, 2011.

(51) Int. Cl.

| | |
|---|---|
| ***F21V 29/00*** | (2015.01) |
| ***F21V 29/505*** | (2015.01) |
| ***F21K 9/233*** | (2016.01) |
| *F21V 29/77* | (2015.01) |
| *F21Y 115/10* | (2016.01) |

(52) U.S. Cl.

CPC ..... *F21V 29/505* (2015.01); *F21K 9/233* (2016.08); *F21V 29/773* (2015.01); *F21Y 2115/10* (2016.08)

(58) Field of Classification Search

CPC ..... F21V 7/00; F21V 29/505; H01L 33/04; H01L 21/02458; H01L 33/16

USPC ..... 362/294, 373

See application file for complete search history.

(56) References Cited

U.S. PATENT DOCUMENTS

| | | | | |
|---|---|---|---|---|
| 8,220,970 | B1 * | 7/2012 | Khazi et al. | 362/294 |
| 2005/0111234 | A1 * | 5/2005 | Martin | F21S 6/003 362/555 |
| 2009/0109625 | A1 * | 4/2009 | Booth | F21K 9/00 361/702 |
| 2010/0039822 | A1 * | 2/2010 | Bailey | 362/296.1 |
| 2010/0096967 | A1 * | 4/2010 | Marinus et al. | 313/46 |
| 2010/0124058 | A1 * | 5/2010 | Miller | 362/249.02 |
| 2011/0001122 | A1 * | 1/2011 | Ahn | 257/13 |
| 2012/0161099 | A1 * | 6/2012 | Jiang et al. | 257/13 |

OTHER PUBLICATIONS

Polkovnikov, Anatoli S., and Georgy G. Zegrya. "Auger Recombination in Semiconductor Quantum Wells." Http://arxiv.org/. N.p., Dec. 8, 1998. Web. Jan. 7, 2014. <http://arxiv.org/pdf/cond-mat/9812125.pdf>.*

"What Are MR16 Lamps?" Lighting Research Center. Rensselaer Polytechnic Institute, Dec. 31, 2002. Web.*

* cited by examiner

*Primary Examiner* — Evan Dzierzynski
*Assistant Examiner* — Gerald J Sufleta, II
(74) *Attorney, Agent, or Firm* — Edmar M. Amaya, Esq.

(57) ABSTRACT

A thermally conducting reflector is employed to serve as dual-use thermal conductor and light reflector for collimating a multi-chip LED array. The thermally conducting reflector consists of a heat sink, item, a reflector made of a thermally conducting and optically reflective material such as aluminum, item, a transparent cover, item, and lamp base that is electrically isolating, item and a common lighting electrical connector, item, illustrated as an Edison type screw base. The novelty in the present invention is how the items are structured to work together to dissipate heat.

9 Claims, 16 Drawing Sheets

REFLECTOR LAMP WITH IMPROVED HEAT DISSIPATION AND REDUCED WEIGHT

CROSS REFERENCE TO RELATED APPLICATIONS

This application claims priority from U.S. Provisional Patent Application Ser. No. 61/476,778, entitled "Reflector Lamp with Improved Heat Dissipation and Reduced Weight", filed on 19 Apr. 2011. The benefit under 35 USC § 119e of the United States provisional application is hereby claimed, and the aforementioned application is hereby incorporated herein by reference.

TECHNICAL FIELD OF THE INVENTION

The present invention relates generally to a reflector lamp that provides enhanced natural convection cooling for heat sensitive lighting devices such as LEDs. More specifically, the present invention relates to a thermally conducting reflector employed to serve as a dual-use thermal conductor and a light reflector to improve cooling performance and reduce weight.

BACKGROUND OF THE INVENTION

Many lighting spaces utilize lighting in which the light is produced through the process of incandescence and halogen enhanced incandescence. Although the light produced at high color rendering index correctly brings out the color in merchandise halogen and incandescent lights suffer from poor luminous efficacy or the ratio of lumens produced and electrical power consumed. Light emitting diodes utilizing mixed leakage blue plus blue converted to yellow through phosphor, UV pumped combinations of blue, green, red phosphors, hybrids of blue, phosphor converted yellow and direct emission red can produce warm white efficacy>125 lumens/watt or up to 8 times higher luminous efficacy. Light emitting diode lamps require a means to conduct the heat away from the light source to ensure good operating life>25,000 hours. In the past these thermally dissipating structures have only utilized single path flow through the heat sink while using a thermally inert reflector or light control device.

SUMMARY OF THE INVENTION

The following describes a reflector lamp that provides enhanced natural convection cooling for heat sensitive lighting devices such as LEDs. A thermally conducting reflector is employed to serve as dual-use thermal conductor and light reflector to improve cooling performance and reduce weight.

All light sources convert some form of energy source into radiated energy in the visible spectrum, or light. A byproduct of the energy conversion is waste heat, or hereafter referred to as heat. The management of heat is a critical lighting system function and the practice of which is referred to as thermal management.

LEDs and heat sensitive lighting devices often make use of a heat sink. The functionality of the heat sink is to conduct the heat to a larger surface interface with the surrounding environment. The heat sink must be higher in temperature than the surroundings for heat transfer to occur. Furthermore, heat transfer to the surroundings increases with the temperature difference between the heat sink and the surroundings. Therefore, in order to keep the LEDs as cool as practical, the heat sink must be as hot as possible.

The measure of a heat sink's ability to dissipate heat is its thermal resistance. A heat sink's thermal resistance is defined by the difference in temperature between the hottest point on heat sink and the ambient divided by the quantity of waste heat dissipated. Lower thermal resistance means more effective heat dissipation when comparing two or more heat sinks. Thermal resistance is dependent on the difference in temperature between the heat sink and it's ambient surroundings. Thus, the amount of waste heat a heat sink dissipates is held constant when comparing two or more heat sinks. Furthermore, the thermal resistance of a heat sink in natural convection is dependent on the heat sink's orientation with respect to gravity. It is because heated buoyant air rises in the direction opposite to gravity. The geometry of the heat sink may obtrude the ingress or egress of air through the heat sink to varying degrees. This affects the velocity of the air passing near the heat sink and thus it's thermal resistance.

Thermal conduction is the flow of thermal energy through a solid material. The thermal conductivity of a material, k, is a property of the material that is a measure of how heat flows though the material in proportion to the temperature drop incurred as a result of that flow. Material with high thermal conductivity incur less temperature drop than low thermal conductivity materials for the same heat flow.

A thermal interface is a boundary between two separate solid materials though which heat flows from one solid to another. The term 'thermal contact' hereafter is used to describe a thermal interface of sufficient capacity to conduct heat across a thermal interface without incurring enough temperature reduction across the interface to be detrimental to the function of the thermal system.

There is a large base of prior art of energy efficient lamps that replace standardized low-efficiency halogen reflector lamps. Common standard reflector lamp shapes are Par 38, Par 30, Par 20 and MR16 among others. In most cases, such as lamps with LED sources, a heat sink generally following the shape of the standard is used to dissipate heat into the surrounding via the heat transfer modes of natural convection and radiation. The solution in this patent's scope optimizes the structures to dissipate heat at various orientations with respect to gravity and uses an optical reflector to serve as a critical component in the thermal management system.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings where like numbers represent like elements, which form a part hereof, and in which is shown by way of illustration specific exemplary embodiments disclosing how the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Figure 1:
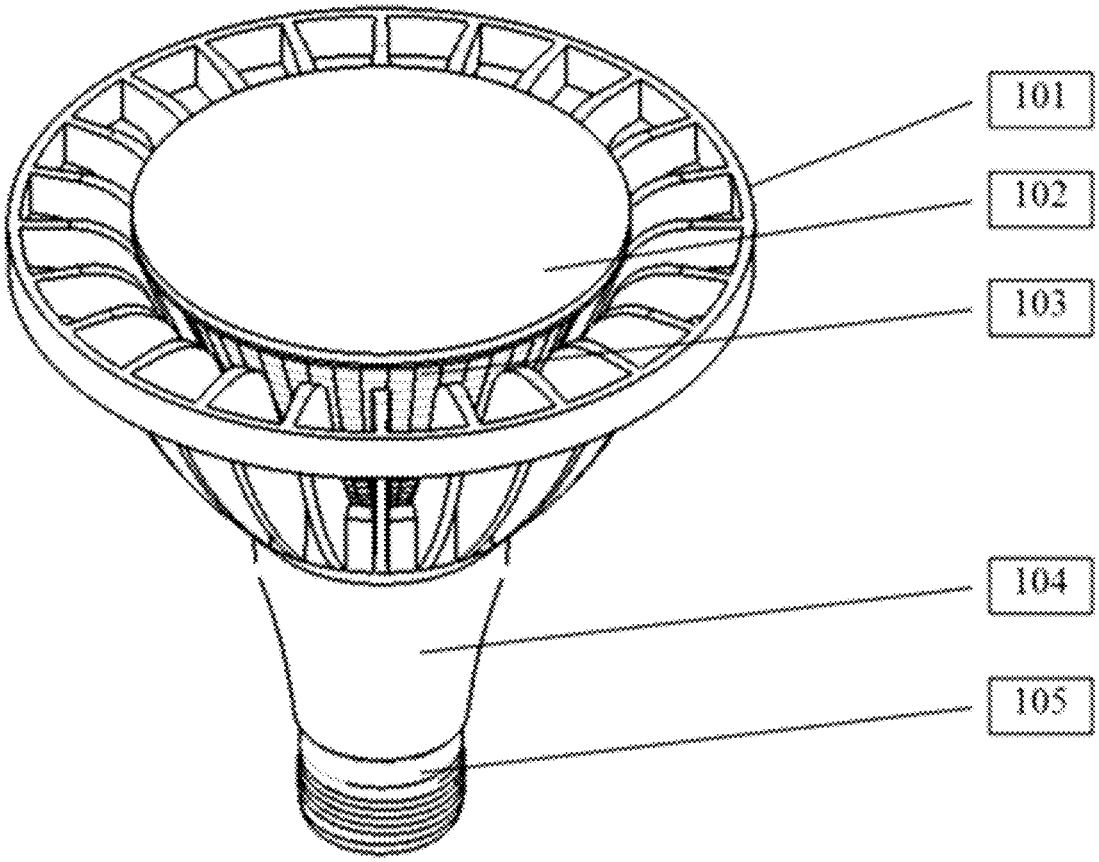
FIG. 1 illustrates a heat sink structure.

Referring to the Figures, it is possible to see the various major elements constituting the apparatus of the present invention. The present invention shown in FIG. 1 consists of a heat sink, item 101, a reflector made of a thermally conducting and optically reflective material such as aluminum, item 103, a transparent cover, item 102, and lamp base that is electrically isolating, item 104 and a common lighting electrical connector, item 105, illustrated as an Edison type screw base. The novelty in the present invention is how items 101 and 103 are structured to work together to dissipate heat. The remainder of the items are common implements.

Figure 2:
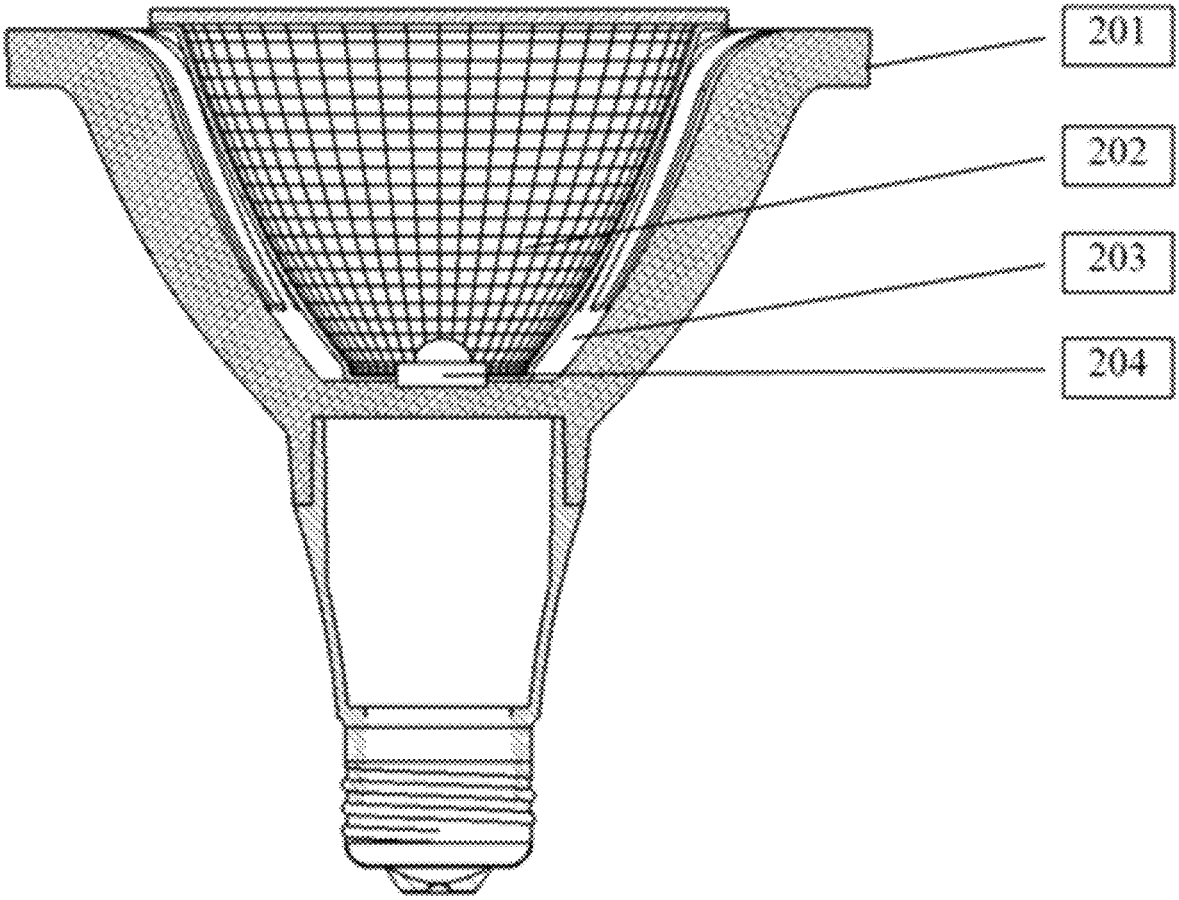
FIG. 2 illustrates a heat sink structure with gap.

FIG. 2 discloses a cross section of the present invention. Item 201 is a heat sink with outer surfaces largely following the profile of a standardized reflector lamp (par 38 illustrated) and inside surfaces largely following the shape of a reflector, item 202. A gap between the reflector and the heat sink, item 203, is introduced to improve thermal convection and thermal radiation cooling. Item 204 is the light source such as an LED mounted in close thermal connection to the heat sink and reflector. The lamp shape illustrated is the form and size of a standard Par 38 halogen lamp.

Figure 3:
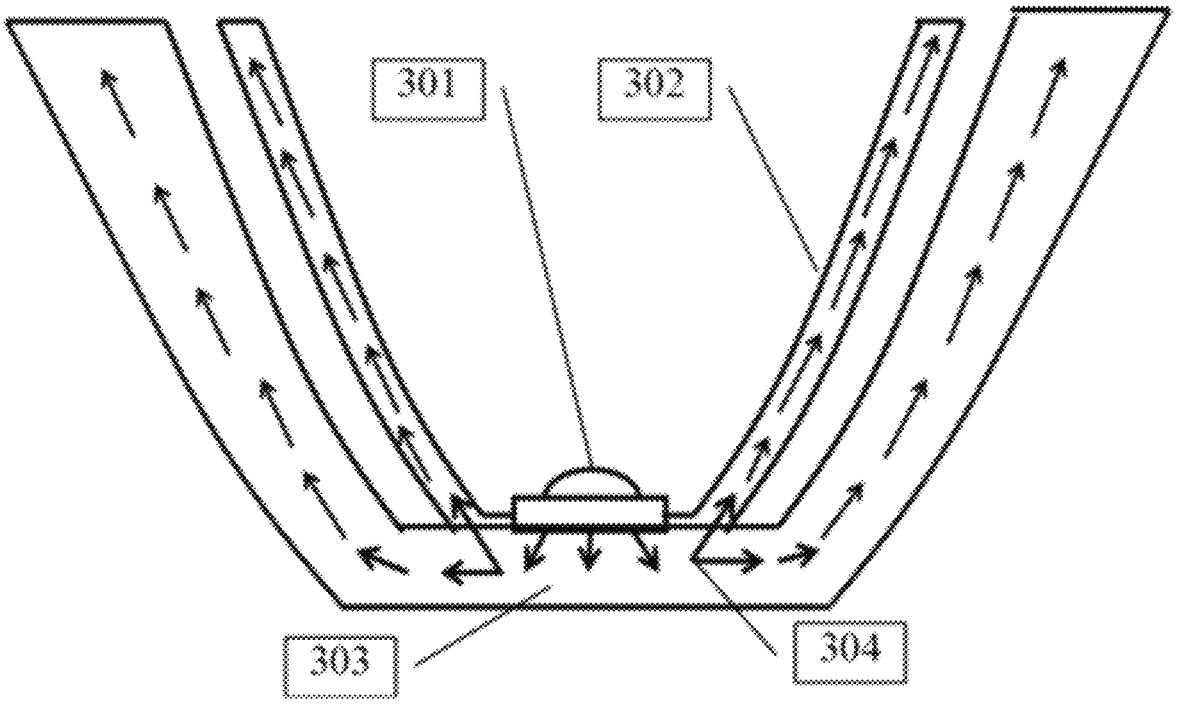
FIG. 3 illustrates a heat sink, Reflector dual thermal conduction paths.

FIG. 3 is an illustration of the thermal conduction path from the heat source, item 301, into the heat sink, item 303 and into the reflector, item 302. Arrows designate the primary direction of the heat flux, or heat flow. At a certain point, item 304, the heat flow splits between the heat sink and reflector parallel paths. In this configuration, the source and the reflector are mounted to and are in thermal contact with the heat sink.

Figure 4:
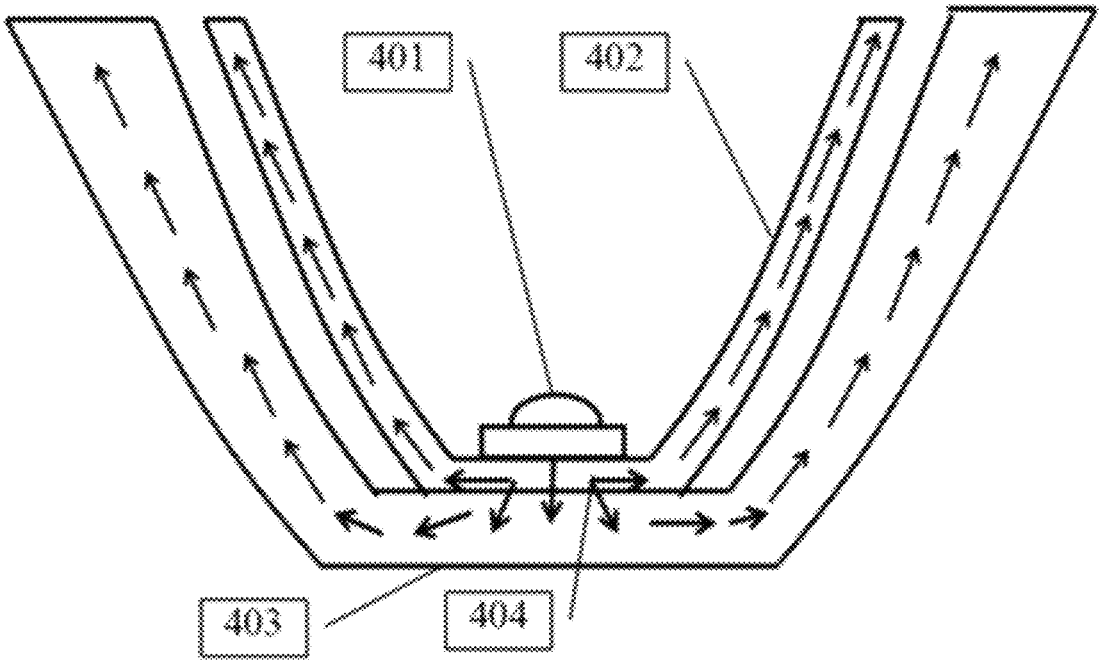
FIG. 4 illustrates a reflector thermal conduction path directly coupled to light source.

FIG. 4 demonstrates an alternate configuration where the heat source, item 401, is mounted in thermal contact with the reflector, item 402, which is in turn mounted in thermal contact with the heat sink, item 403. The points at which the flow paths separate into parallel paths, item 404, is now located in the reflector.

Figure 5:
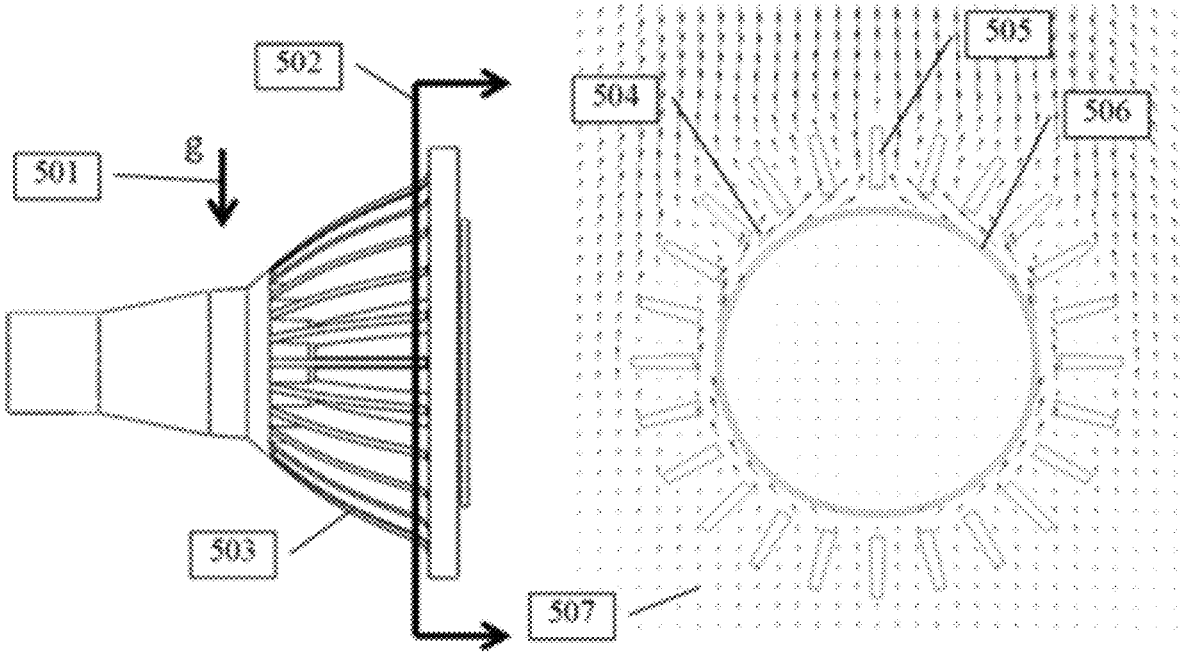
FIG. 5 illustrates an air flow thermal air flow though reflector, heat sink system.

FIG. 5 discloses the result of a numerical thermal simulation that shows the air flow pattern though the heat sink, item 503, and around the reflector, item 506, when the system is oriented horizontally with respect to the direction of gravity, item 501. Item 502 indicates the location of the cross section plane used for the air velocity vector plot, item 507. Item 504 shows the air flow though the gap between the reflector and the heat sink.

Figure 6:
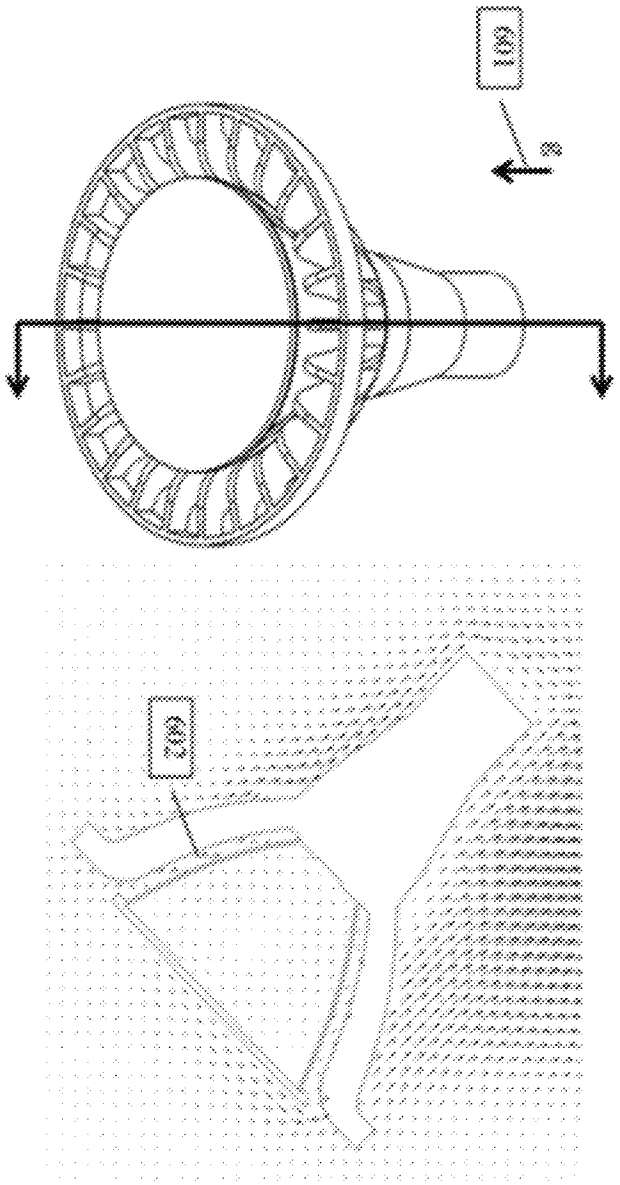
FIG. 6 illustrates an air flow paths through lamp positioned at an angle.

FIG. 6 discloses the result of another thermal simulation with the lamp at a 45 degree angle with respect to the direction of gravity, item 601. Air flow between the reflector and heat sink fins, item 602, is evident.

Figure 7:
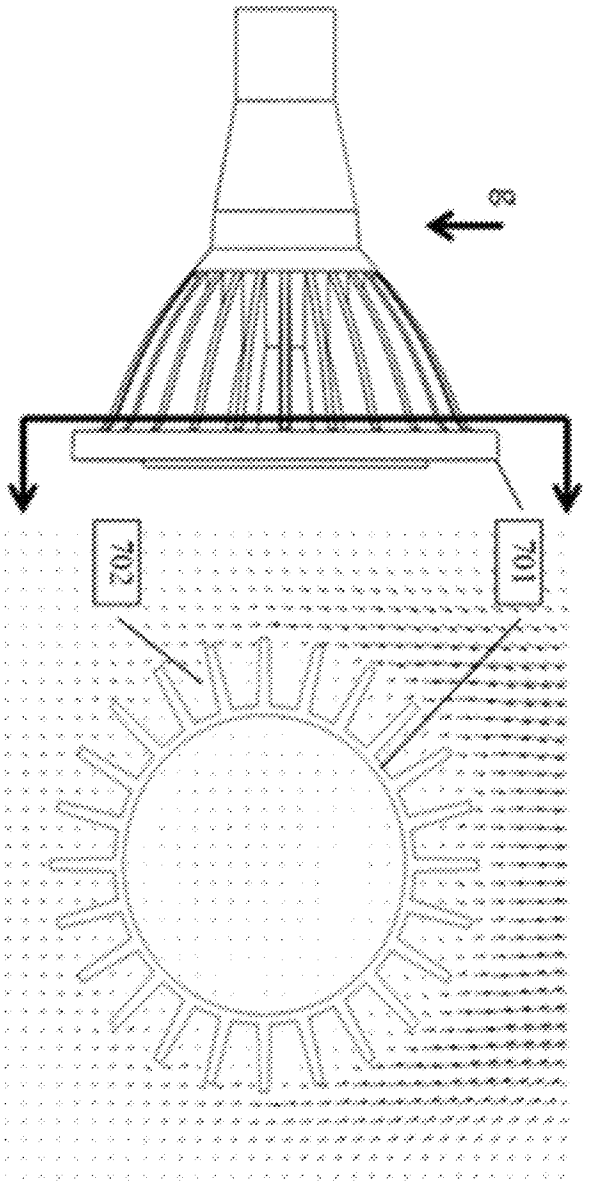
FIG. 7 illustrates an air flow path.

FIG. 7 shows a common heat sink geometry for LED replacements for traditional reflector lamps. The heat sink, item 701, is closed and airflow between fins, item 702, is of low velocity.

Figure 8:
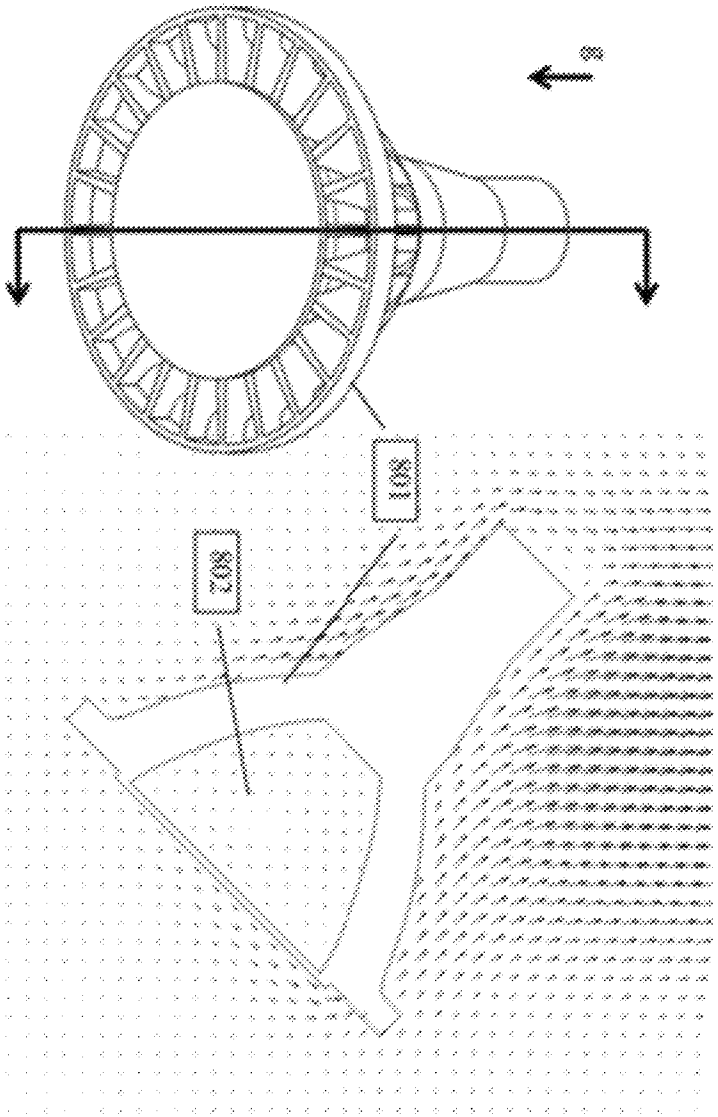
FIG. 8 illustrates an air flow path with lamp positioned with tilt angle.

The lamp and heat sink, item 801, in FIG. 8 is of the same construction as FIG. 7, but with a 45 degree orientation with respect to gravity. Comparing to FIG. 6, any reflector placed inside the closed area, item 802, would not contribute significantly to the overall heat transfer because of the low velocity air inside.

Figure 9:
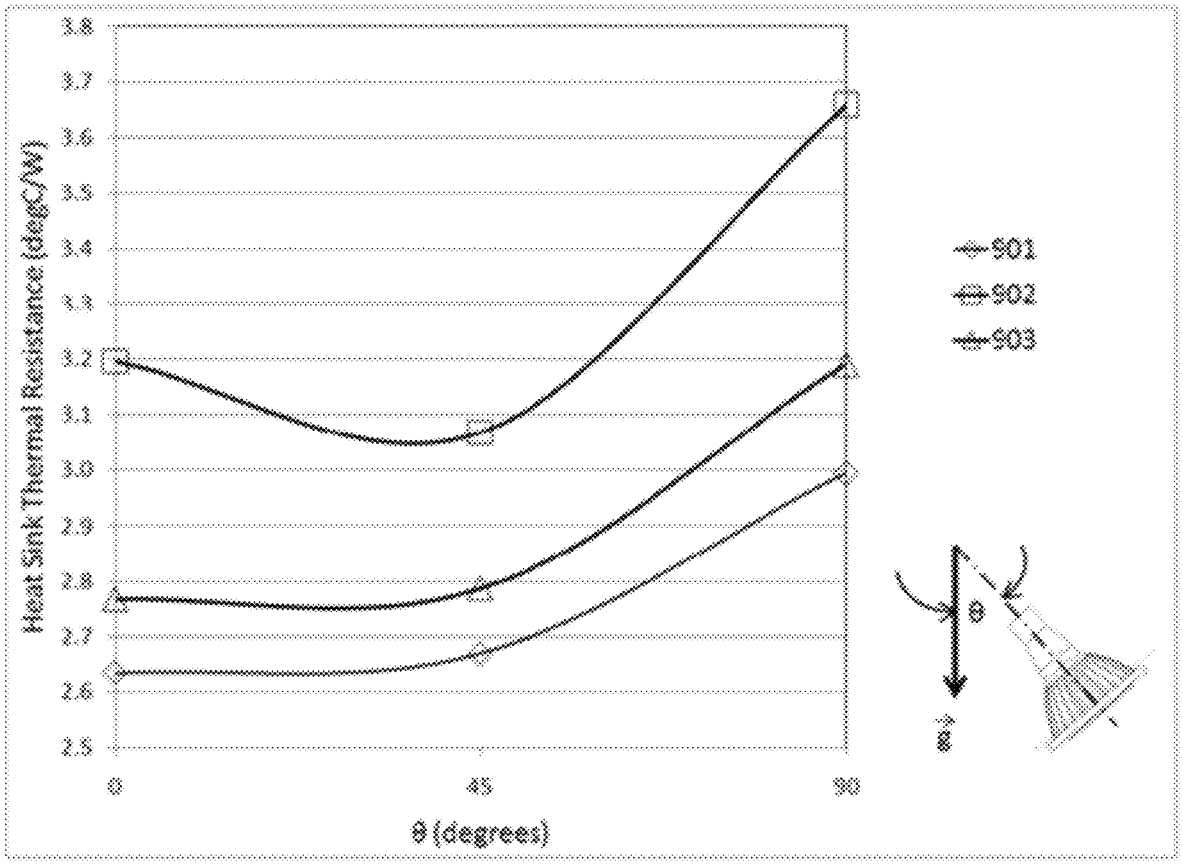
FIG. 9 illustrates single vs. dual heatflow path thermal resistance performance.

FIG. 9 disclose the thermal resistance of several lamp heat sink configurations at different orientations with respect to gravity. Item 901 describes the thermal resistance of the heat sink construction in the present invention, as in FIG. 2, FIG. 5 and FIG. 6. Item 903 is the common heat sink configuration as described in FIG. 1 and FIG. 8. It can be concluded that the thermal performance of 901 and 903 is similar, with the present invention, 901, having slightly lower thermal resistance. The present invention in this reduction to practice has a lower mass. Item 903 has a mass of 0.25 kg and item 901 has a mass of 0.17 kg. The present invention has approximately two-thirds the mass of the conventional construction.

FIG. 9 also demonstrates the utility of the thermally conductive reflector disclosed as item 506 in FIG. 5. Item 902 shows the thermal resistance of the system of the present invention when the reflector material is chosen to be the less thermally conductive material polycarbonate plastic, k=0.2 W/mK. The reduction in thermal resistance from item 902 to item 901 is the effect of the thermally conductive reflector actively participating in convective and radiation heat dissipation from the heat source to the surroundings.

Figure 10:
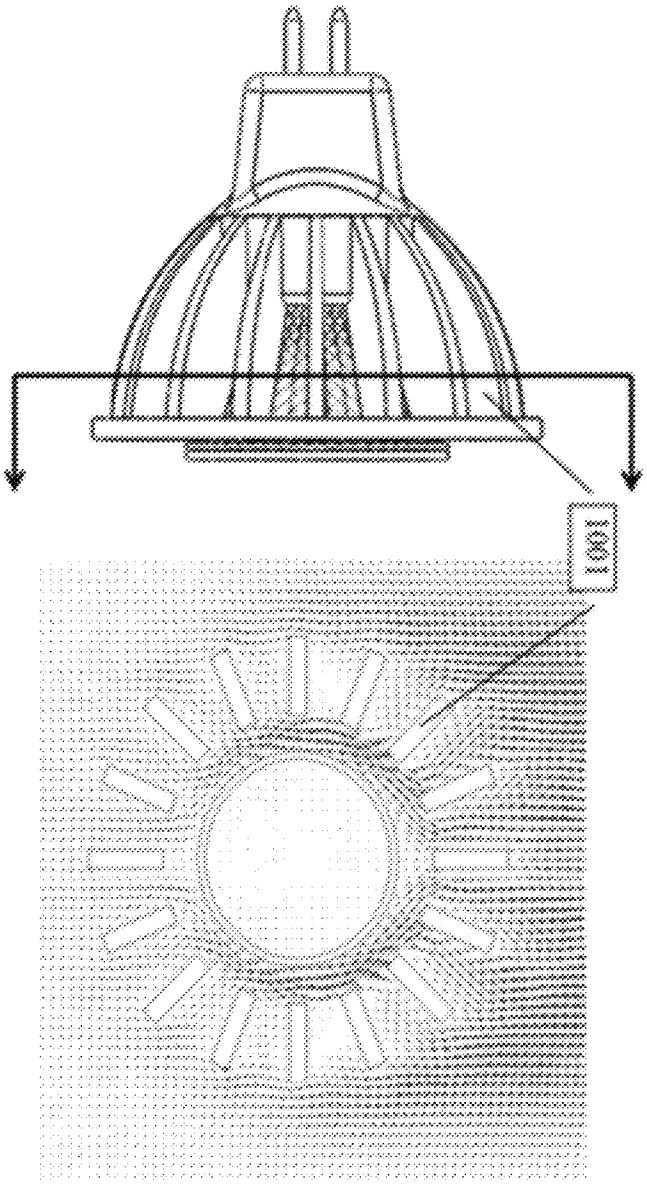
FIG. 10 illustrates a multi-faceted reflector lamp utilizing dual flow.

FIG. 10 demonstrates the invention's utility in the form and size of a standard MR16 lamp, with a size approximately one third of the diameter of the Par 38 lamp described in FIG. 2. Here the lamp is oriented perpendicular to the direction of gravity as in FIG. 7.

An air velocity vector plot shows flow though a passage, item 1002, which resides between the solid fin structure, item 1001, and the thermally conductive reflector, item 1103.

Figure 11:
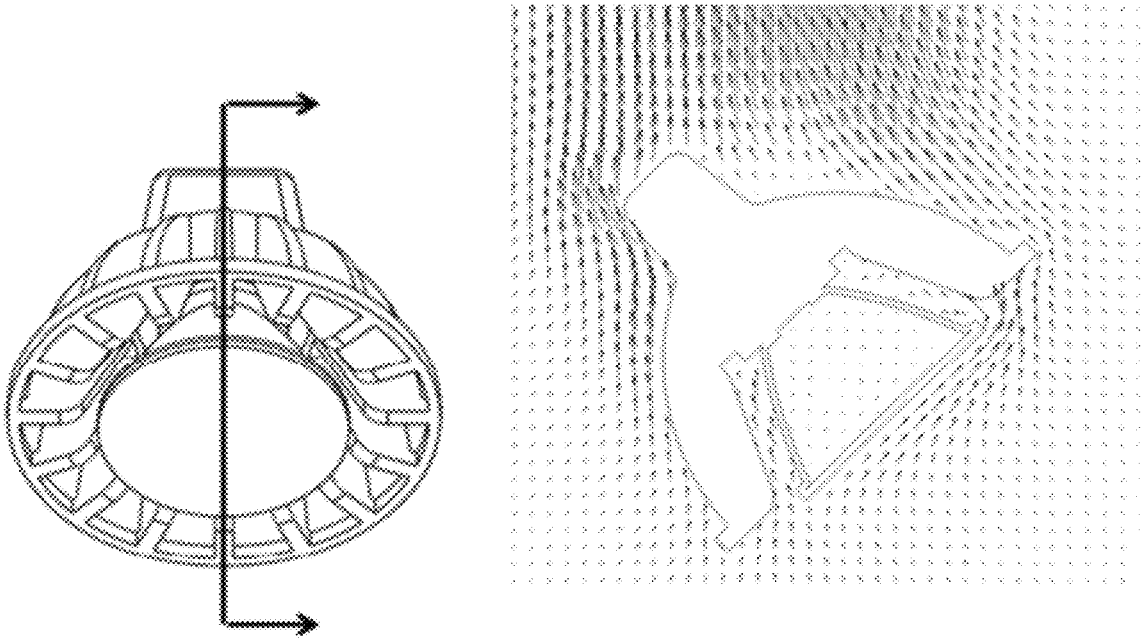
FIG. 11 illustrates a multi-faceted reflector lamp utilizing dual flow at tilt angle.

FIG. 11 also demonstrates the invention's utility to the smaller MR16 lamp standard. Here the lamp is oriented at a 45 degree angle with respect to gravity as in FIG. 8. Convection heat transfer is enhanced by the upward movement of air in the gap, item 1101, represented by arrows, between the heat sink fins, item 1102 and the thermally conductive reflector, item 1103.

Figure 12:
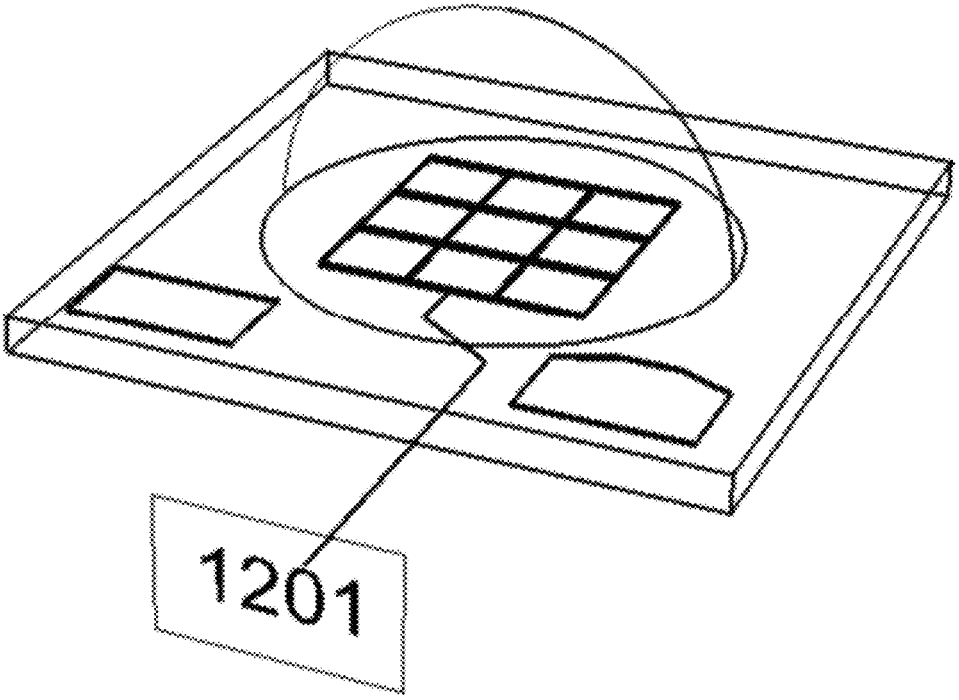
FIG. 12 illustrates an LED source package utilizing multiple chips.

FIG. 12 depicts the multi-chip LED light source array 1201 in which the light emission chips comprise multiple-quantum wells with auger recombination reduction structures comprised of piezoelectric reducers, quantum confinement enhanced nano-phosphors, reduced current crowding, and wavelength scale extraction structure grown on bulk or semi-polar gallium nitride to reduce defect density. In addition the use of direct primary orange and red phosphors pumped through 75% wall plug efficiency blue luminescence devices grown on bulk gallium nitride serves as an alternative to the thermal quenching of red seen in AlGaInP CRI enhancing red chips. The light extraction dome shown in the device 1201 enhances light extraction from the chips at the cost of magnified source imaging and reduced luminance. Multi-chip light sources such as 1201 also enhance electrical conversion efficiency AC to DC when the chips are wired in series thereby reducing the step down voltage required. The multi-chip light source produces the light used in the lamps.

Figure 13:
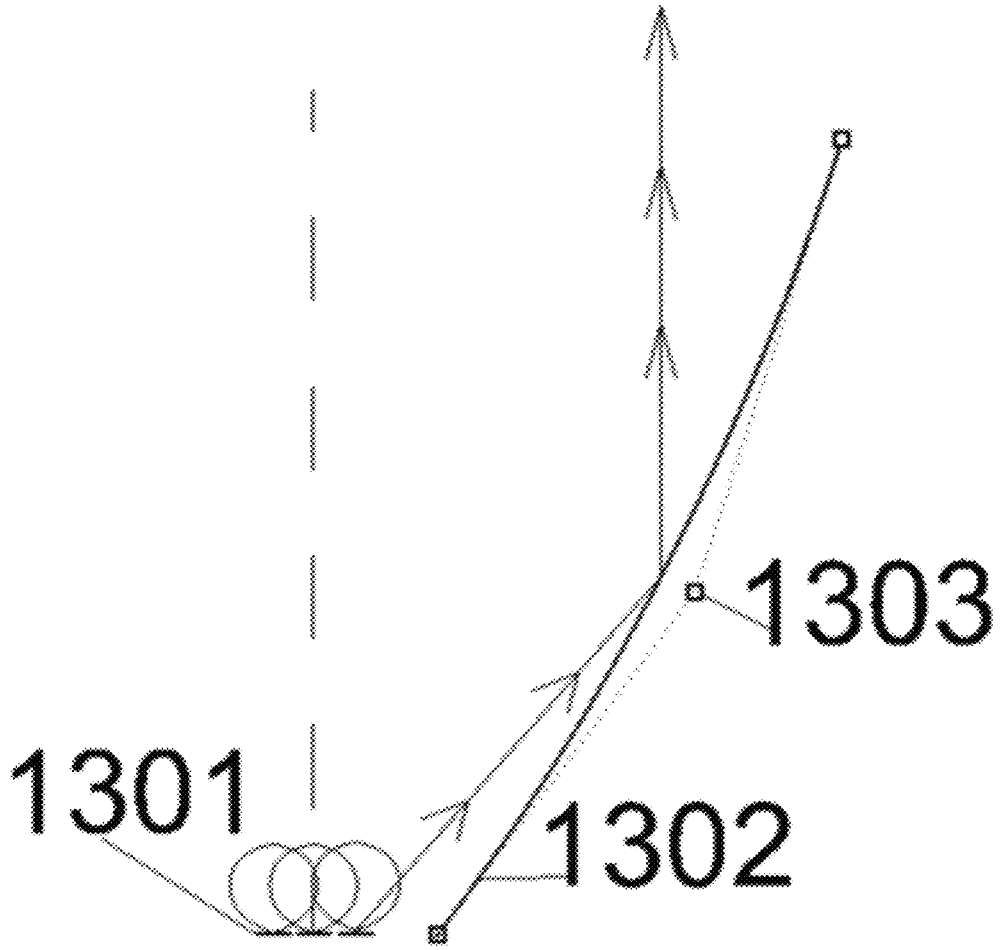
FIG. 13 illustrates a weighted Bezier spline reflector collimation device.

FIG. 13 shows the 3×3 or 9 chip LED light source 1301 within a light control device 1302. The light control device 1302 described by a weighted Bezier spline includes a control point 1303 used to manipulate the light bundles emerging from the extended light source 1301. Light source collimation enhances intensity or candela/lumen of light emitted by the lamp. The light control device 1302 serves a dual purpose both providing a secondary thermal flow path not shown in the figure and a reflective layer geometry which redirects the light towards the illumination areas of interest.

Figure 14:
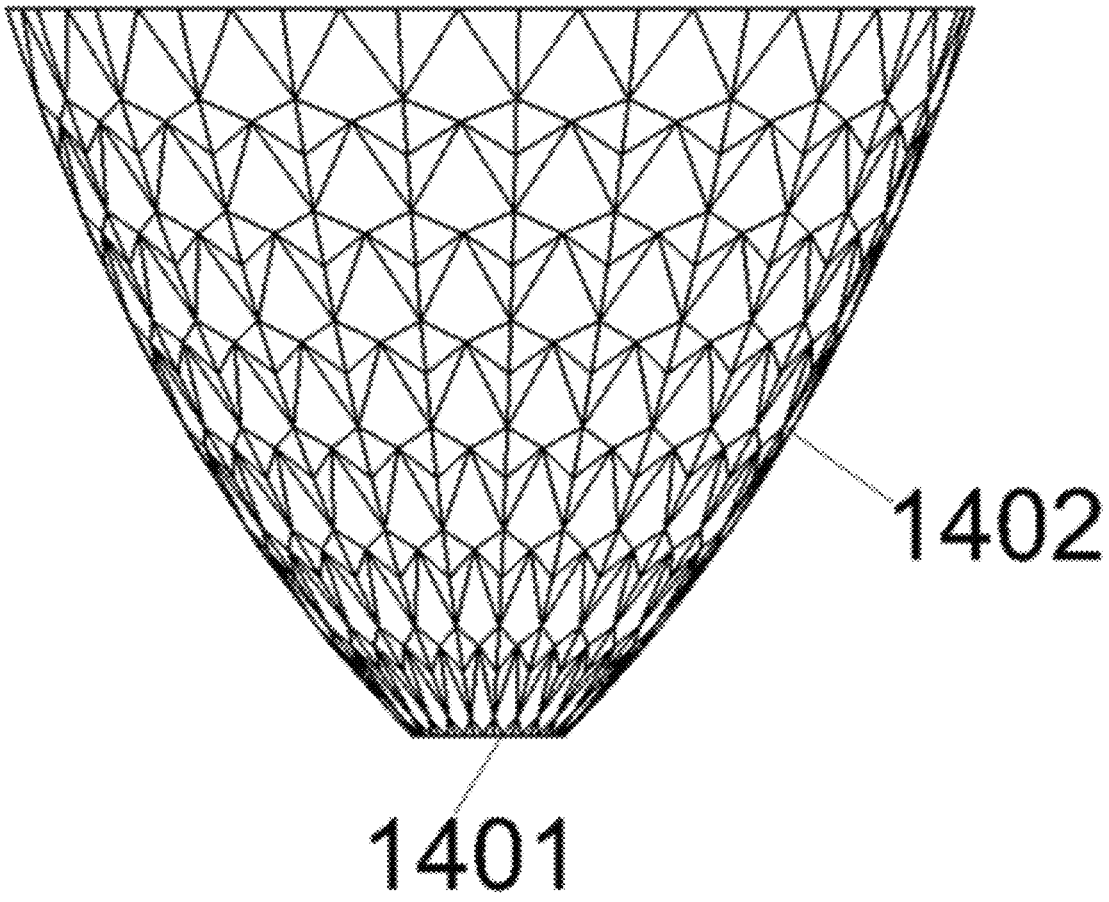
FIG. 14 illustrates a weighted Bezier spline multi-control cell reflector device.

FIG. 14 is an optical control device 1401 comprised of layers and sections of multi-control primitives 1402. These multi-control optical primitives redirect light to fill in areas of depressed illuminance thereby reducing imaging through decorative or controlled aberration induced uniformity enhancement.

Figure 15:
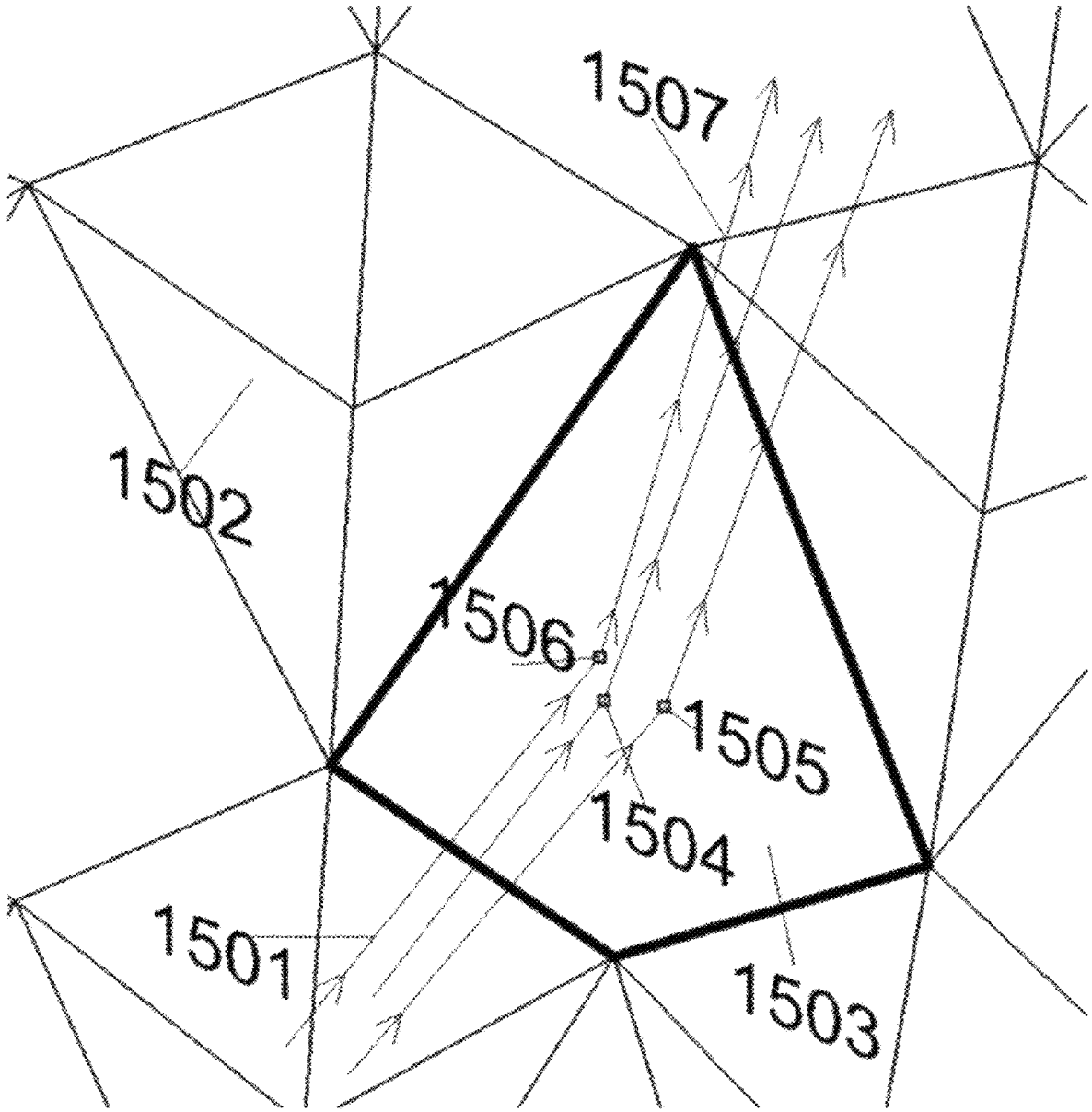
FIG. 15 illustrates a multi-control light cell.

FIG. 15 depicts one of the many multi-control primitives 1502 used to optically guide, direct, and collimate the light. A light bundle 1501 incident upon the multi-control primitive 1503, reflects through operation of the Bezier spline reflector at points 1504, 1505, and 1506 respectively. Light bundle 1507 emerges from the multi-control device with light which is spatially more uniform. The composite light beam produced through the combined effect of the multi-control primitives is a uniform light distribution.

Figure 16:
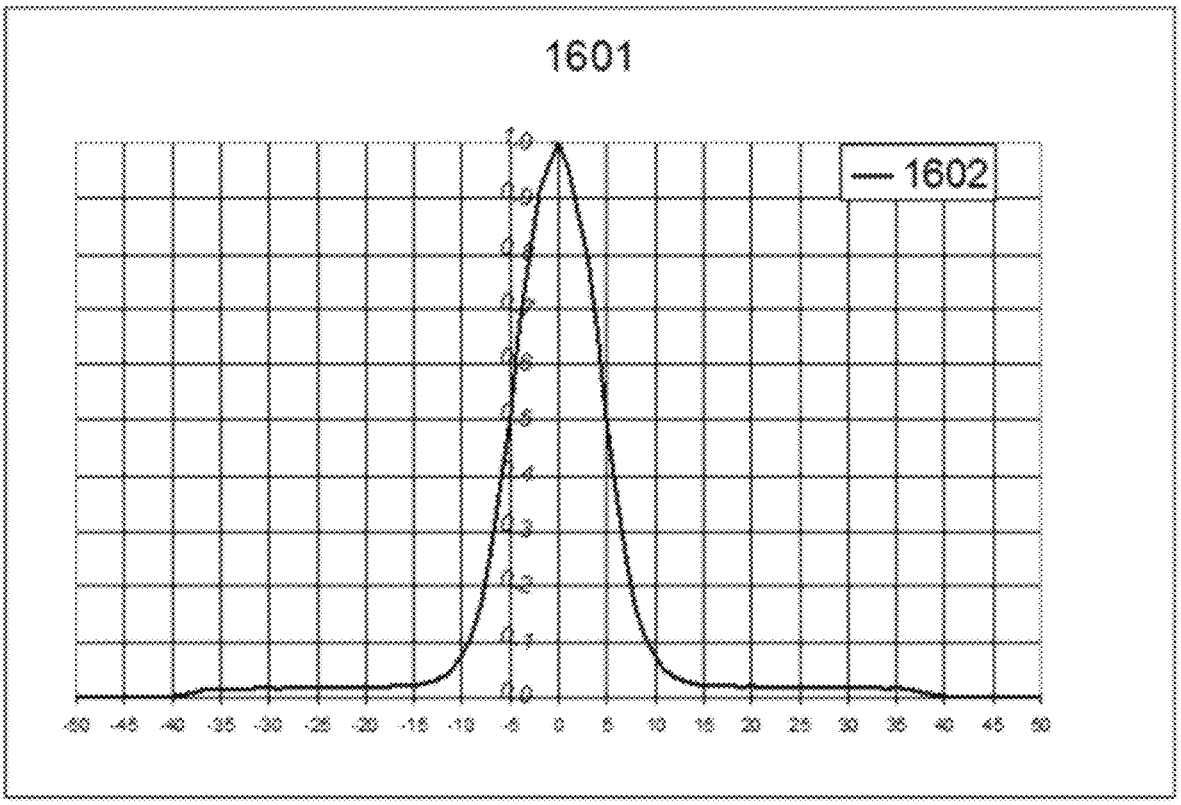
FIG. 16 illustrates a multi-cell reflector light distribution.

FIG. 16 is a chart representation 1601 of the relative intensity 1602 or light dispersion of the energy over an angular range of −90 to 90 deg.

Furthermore, other areas of art may benefit from this method and adjustments to the design are anticipated. Thus, the scope of the invention should be determined by the appended claims and their legal equivalents, rather than by the examples given.

We claim:

1. A thermally conducting reflector device employed to serve as dual-use thermal conductor and light reflector for collimating a multi-chip LED array comprising:

a heat sink;

a thermally conductive reflector made of a thermally conducting and optically reflective material;

the thermally conductive reflector is adhered directly to the heat sink;

a transparent cover;

a lamp base that is electrically isolating; a common lighting electrical connector;

the heat sink is further comprised of outer surfaces conforming to a profile of the thermally conductive reflector lamp and inside surfaces conforming to the profile of the thermally conductive reflector lamp;

a gap between the thermally conductive reflector and the heat sink is introduced to improve thermal convection and thermal radiation cooling; and a light source such as an LED mounted in thermal connection to the heat sink and thermally conductive reflector;

a multi-chip LED light source array comprised of light emission chips;

an LED light source within a light control device;

the light control device described by a weighted Bezier spline reflector includes:

a control point used to manipulate light bundles emerging from the LED light source within a light control device;

a light control device enhanced collimation intensity or candela/lumen of a light emitted by the LED light source; and the light control device serves a dual purpose both providing a secondary thermal flow path and a reflective layer geometry which redirects the light towards illumination areas of interest.

2. The device of claim 1, wherein the multi-chip LED array and the thermally conductive reflector are mounted to and in thermal contact with the heat sink;

the heat flow splits into parallel paths between the heat sink and reflector; and the heat conduction path is from the multi-chip LED array, acting as the heat source into the heat sink and into the thermally conductive reflector.

3. The device of claim 2, wherein the heat source is mounted in thermal contact with the thermally conductive reflector;

the thermally conductive reflector is in turn mounted in thermal contact with the heat sink;

the heat sink is further comprised of dual flow heat sink fins; and the points at which the flow paths separate into parallel paths are now located in the reflector.

4. The device of claim 3, wherein the device is oriented horizontally with respect to the direction of gravity.

5. The device of claim 3, wherein the device is placed at a 45 degree angle with respect to the direction of gravity.

6. The device of claim 3, wherein the device is in the form and size of a standard MR16 lamp; and the device is oriented perpendicular with respect to the direction of gravity.

7. The device of claim 3, wherein the device is in the form and size of a standard MR16 lamp; and the lamp is oriented at a 45 degree angle with respect to gravity.

8. The device of claim 1, further comprising a plurality of layers and sections of multi-control primitives;

these multi-control optical primitives redirect light to fill in areas of depressed illuminance thereby reducing imaging through decorative or controlled aberration induced uniformity enhancement.

9. The device of claim 8, further comprising one of a plurality of multi-control primitives used to optically guide, direct, and collimate the light;

wherein a light bundle incident upon the multi-control primitive, reflects through operation of a Bezier spline reflector at points respectively;

a light bundle emerges from the multi-control device with light which is spatially more uniform; and a composite light beam produced through the combined effect of the multi-control primitives is a uniform light distribution.

* * * * *